US005348273A

United States Patent [19]

Sandell et al.

[11] Patent Number: 5,348,273

[45] Date of Patent: Sep. 20, 1994

[54] LIFTING APPLIANCE, ESPECIALLY FOR A PATIENT LIFTING DEVICE

[75] Inventors: Anders L. Sandell, Landskrona; Leif B. Sonesson, Eslöv; Bo G. Persson, Löddeköpinge, all of Sweden

[73] Assignee: Arjo Hospital Equipment AB, Eslöv, Sweden

[21] Appl. No.: 93,631

[22] Filed: Jul. 20, 1993

Related U.S. Application Data

[63] Continuation of Ser. No. 597,697, Oct. 17, 1990, abandoned.

[30] Foreign Application Priority Data

Oct. 17, 1989 [SE] Sweden ..... 8903411-0

[51] Int. Cl.[5] ..... B66F 11/00; B66F 17/00

[52] U.S. Cl. ..... 254/385; 5/81.1; 254/273; 254/277

[58] Field of Search ..... 254/385, 386, 273, 270, 254/277, 4 R, 7 R, 6 R, 272; 5/42.4, 81.1

[56] References Cited

U.S. PATENT DOCUMENTS

| | | | |
|---|---|---|---|
| 915,604 | 3/1909 | Hyslop | 254/386 |
| 1,882,036 | 10/1932 | Remde . | |
| 2,683,882 | 7/1954 | Smith | 254/386 |
| 3,053,344 | 9/1962 | Buck | 254/273 |
| 3,710,424 | 1/1973 | Smejkal et al. | 254/385 |
| 4,359,207 | 11/1982 | Maryonovich | 254/272 |
| 4,420,122 | 12/1983 | Maslo | 254/272 |
| 4,499,971 | 2/1985 | Luebrecht | 254/273 |
| 4,838,492 | 6/1989 | Berry | 254/386 |

FOREIGN PATENT DOCUMENTS

| | | |
|---|---|---|
| 0267888 | 11/1987 | European Pat. Off. . |
| 3602105 | 1/1986 | Fed. Rep. of Germany . |
| 86048097 | 5/1988 | Sweden . |

*Primary Examiner*—Katherine Matecki

[57] ABSTRACT

A lifting appliance, especially for a patient lifting device, comprises a telescopic column (10) having a carriage (22) which is reciprocable in the longitudinal direction of the column under the action of the telescopic extension and retraction motions of the column. The appliance comprises safety means (37) which are adapted to stop the telescopic motions of the column, in case of defects in the power transmission between a driving motor (15) producing the telescopic motions of the column, and the carriage (22), or if the carriage (22) or a lifting means connected therewith should be stopped by some object in its downward motion.

12 Claims, 6 Drawing Sheets

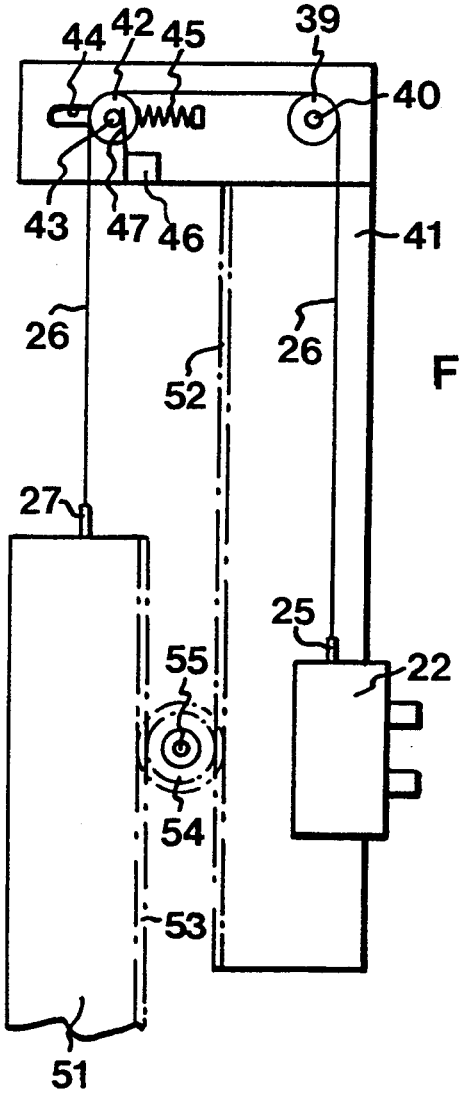
FIG. 7
FIG. 8
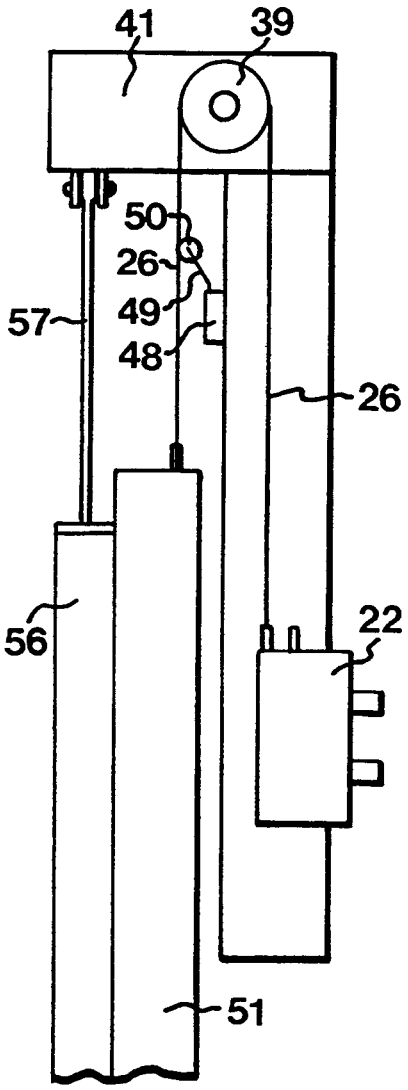

LIFTING APPLIANCE, ESPECIALLY FOR A PATIENT LIFTING DEVICE

This application is a continuation, of application Ser. No. 07/597,697 filed on Oct. 17, 1990, now abandoned.

BACKGROUND OF THE INVENTION

The present invention relates to a lifting appliance having a telescopic column and a lifting means mounting which is supported by said column and which, during telescopic extension and retraction of the column, can be set in optional vertical positions.

Such lifting appliances are frequently used in care of the sick and aged as patient lifting devices which are usually mounted on an undercarriage to enable the patient carried by the lifting appliance to be moved between different locations. The patient lifting appliance is, in a prior art design, to be compared to a crane where the lifting means mounting is rigidly attached to the displaceable part of the telescopic column, thereby following the vertical motions of the displaceable part. In other prior art lifting appliances, use is made of an unextendable column provided with a carriage serving as the lifting means mounting, said carriage being reciprocable, by means of a driving motor, in the longitudinal direction of the column. The last-mentioned type of prior art appliances suffers from the drawback that the length of the column must be sufficient for the entire desired hoisting motion of the carriage, whereas a disadvantage of the first-mentioned type using a telescopic column is that the stroke of the telescopic column corresponds to the maximum lifting distance of the lifting means, which results in, inter alia, a considerable overall height also in the completely retracted state. To eliminate these drawbacks, DE-A-3,602,105 and EP-A-0,267,888 suggest a lifting appliance, especially for a patient lifting device, comprising a column having two telescopically cooperating column elements and a driving motor for adjusting the length of said column and having a lifting means mounting consisting of a carriage which is movable to optional positions along one column element by means of a belt attached to said carriage and running over a deflecting roller mounted on one column element, to a belt attachment on the other column element. This prior art design gives the lifting appliance a small overall height and great vertical adjustability of the lifting means mounting. Yet there are some drawbacks with respect to safety in operating the lifting appliance. Thus, it is necessary to arrest the telescopic motion of the column in case of defects in the power train, or in case the carriage or a lifting means connected therewith should be stopped by some object in its downward movement.

SUMMARY OF THE INVENTION

One object of the present invention therefore is to eliminate the drawbacks of prior art lifting appliances, especially for patient lifting devices, and to provide a lifting appliance having built-in safety means for arresting the hoisting motion if an obstacle is met with as the column is being retracted.

A further object of the invention is to provide a lifting appliance which comprises a sensing means for sensing any interruption in the power transmission between the driving motor of the lifting appliance and the lifting means mounting.

To sum up, the invention relates to a lifting appliance, especially for a patient lifting device, said lifting appliance comprising a telescopic column provide with a carriage which is reciprocable in the longitudinal direction of said column under the action of the telescopic extension and retraction motions of the column. The appliance comprises safety means which are adapted to stop the telescopic motion of the column, in case of defects in the power transmission between the carriage and a driving motor which produces the telescopic motions of the column, or if the carriage or a lifting means connected therewith should be stopped by some object in its downward movement.

BRIEF DESCRIPTION OF THE DRAWINGS

The invention will now be described in more detail with reference to the accompanying drawings illustrating some preferred embodiments of the invention.

FIG. 7 is a schematic view of another embodiment of the appliance according to the invention.

FIG. 8 is a schematic view of a further embodiment of the invention.

DESCRIPTION OF THE PREFERRED EMBODIMENTS

Figure 1:
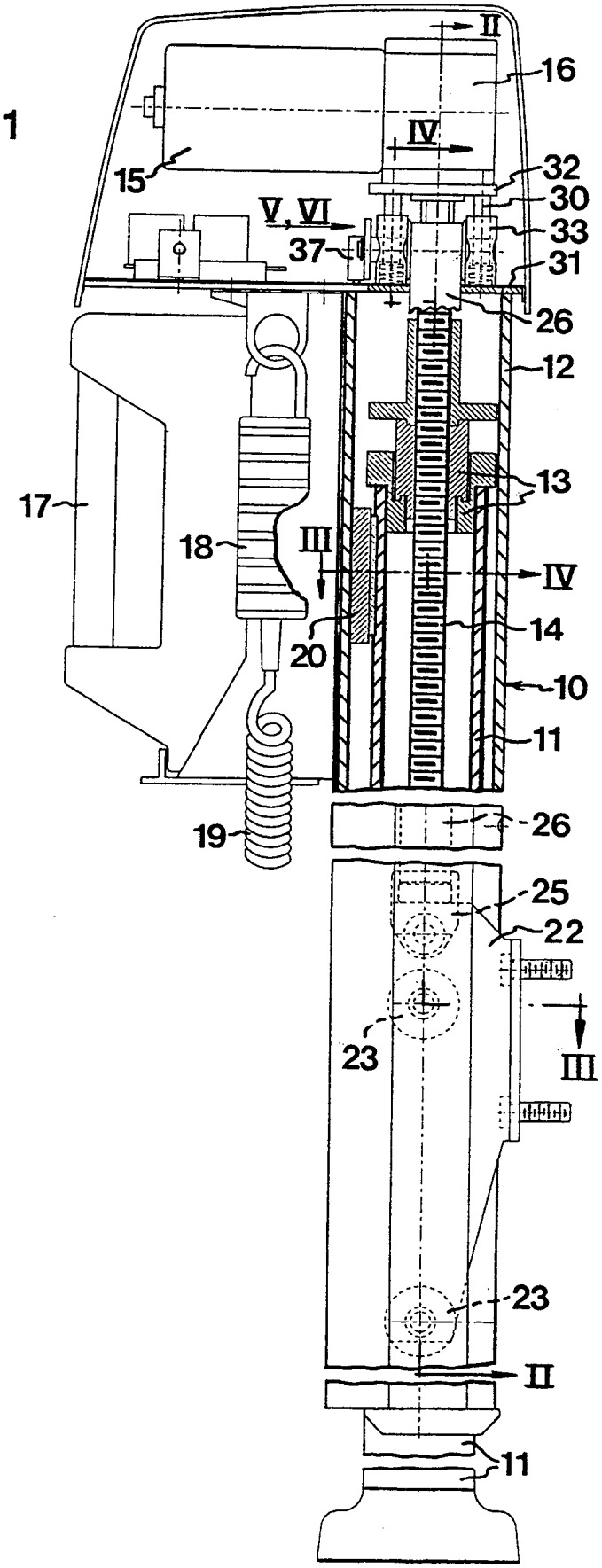
FIG. 1 is a side view, partly in section of an embodiment of a lifting appliance according to the invention.

The embodiment of a lifting appliance according to the present invention, as illustrated in FIGS. 1–6, comprises a telescopic column 10 consisting of a first column element 11 and a second column element 12. The column element 11 can be mounted on an undercarriage (not shown) for making the lifting appliance movable. In this embodiment, the two column elements 11, 12 are designed as tubular sections. A nut means 13 is mounted at the upper end of the column element 11. The nut means cooperates with an adjusting screw 14 which is non-displaceably connected to the column element 12 and extends downwardly through the column elements. The upper end of the adjusting screw 14 is connected to a driving motor 15 having a worm gear 16 for rotating the screw 14. The driving motor 15 is reversible. A power pack 17 is also mounted on the column element 12, but the appliance should also be drivable by an external source of power. A control handle 18 and a cord 19 make it possible to control the operation of the motor 15 at a distance from the lifting appliance.

Figure 3:
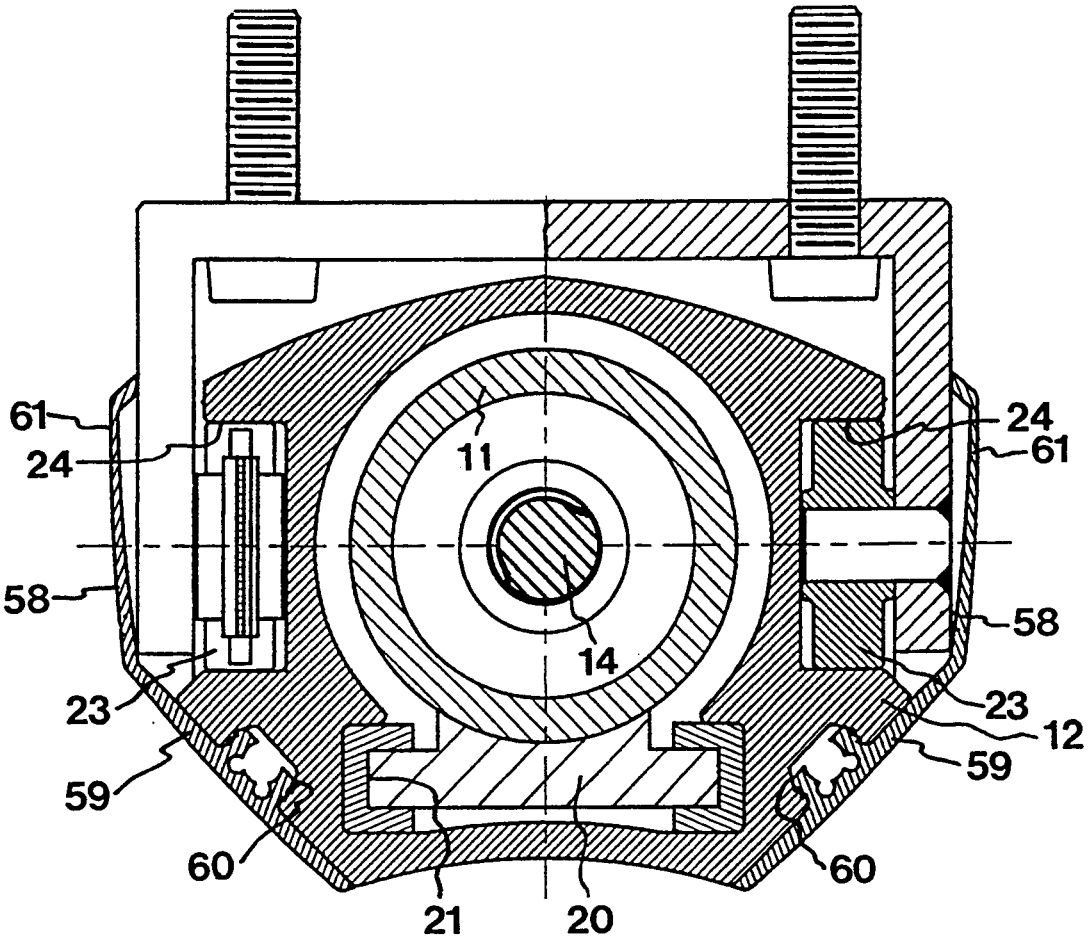
FIG. 3 is a cross-section along the line III—III in FIG. 1.

For guiding the column elements 11, 12 relative to one another, a key 20 is attached to the column element 11 and slides in an undercut key groove 21 formed in the column element 12 (see FIG. 3).

In the embodiment of the appliance as illustrated, a lifting means mounting is designed as a carriage 22 which by two pairs of wheels 23 is guided in grooves 24 on opposite sides of the column element 12. In this embodiment, the carriage 22 is provided with two belt attachments 25 for regulating belts 26 which are, at the other end, connected to belt attachments 27 mounted on the nut means 13 and which run over deflecting rollers 28. The deflecting rollers are each rotatable about a shaft 29 and supported by the column element 12. By this arrangement, a telescopic motion of the column elements 11, 12 which has a certain length of stroke will cause a displacement of the carriage 22 relative to the column element 11 by a length of stroke which is twice as long. This arrangement makes the lifting motion quicker than the telescopic motion.

FIG. 3 illustrates angular sections 58, one leg 59 of which is secured in a groove 60 formed in the column element 12 and the other leg 61 of which is resiliently pressed against the column element 12 and the carriage 22 on the other side of the groove 24. The rollers 23 of the carriage travel in the grooves 24, but the roller mounting project between the column element 12 and the legs 61.

In the embodiment illustrated in FIGS. 1–6, the shafts 29 of the deflecting rollers 28 are connected to the upper end of the column element 12 by guides 30. The guides extend between an upper end plate 31 and a motor mounting plate 32 at the upper end of the column element 12. The shafts 29 are formed with two through holes and are, at each end, passed over a guide 30. The shafts and the guides are further interconnected by a slide 33 which restricts the motion of the deflecting rollers in the longitudinal direction along the guides 30. A recess 34 in the form of a bottom hole is formed in the end of the slides 33 facing the plate 31. In this recess 34, a compression spring 35 is mounted. The compression spring 35 surrounds the guide 30 and actuates the slide 33 in the upward direction towards the plate 32. The shafts 29 are, at one end, interconnected by an arm 36 which is pivotally connected to the shaft ends. At least one end of the arm has an elongate hole for accommodating the corresponding shaft 29. The arm 36 supports a microswitch 37 whose sensing arm 38 is spring-loaded in the direction of the plate 31.

The microswitch 37 is connected in the regulating circuit of the driving motor 15 and serves to discontinue the motor drive, if one or both belts 26 should break, or if the downward motion of the carriage 22 should be stopped by some external obstacle.

Figure 2:
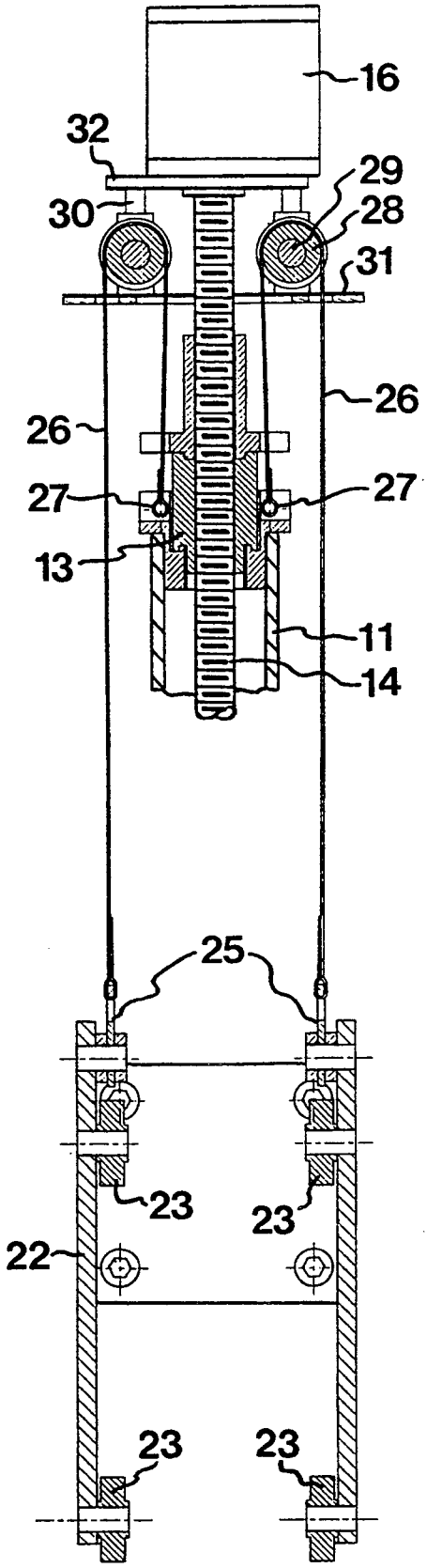
FIG. 2 is a cross-section along the line II—II in FIG. 1, with certain parts removed.
Figure 5:
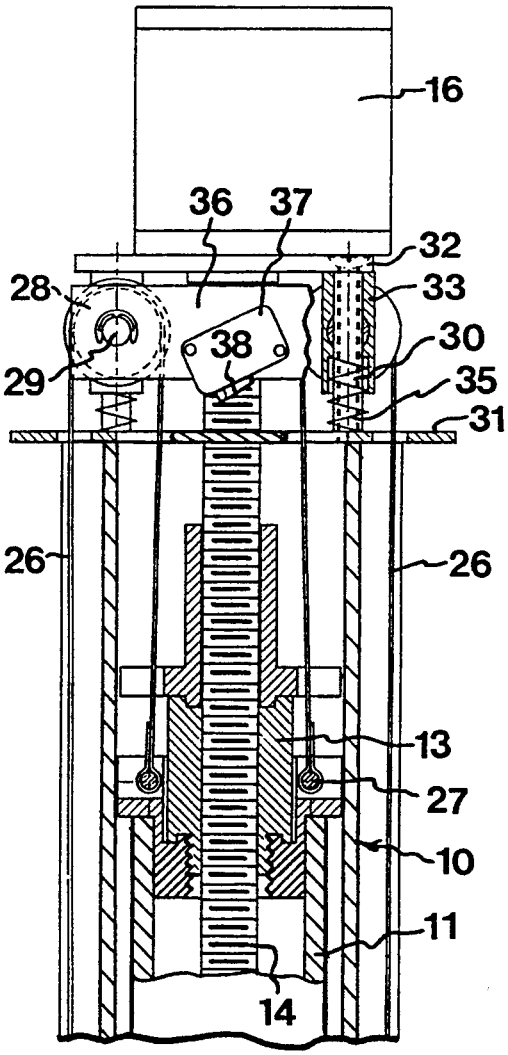
FIG. 5 is a schematic view of certain parts of the appliance in FIG. 1, as seen in the direction of the arrow V—V.
Figure 6:
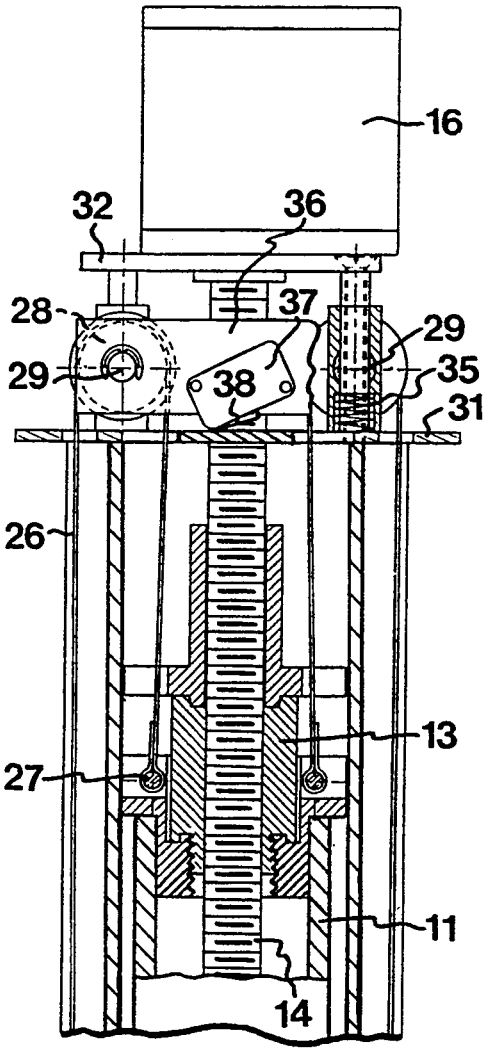
FIG. 6 is a schematic view of certain parts of the appliance in FIG. 1, as seen in the direction of the arrow V—V.

The function of the safety means will now be explained in more detail with reference to FIGS. 1–6. FIGS. 1, 2 and 6 show the safety means under normal working conditions, i.e. when both belts 26 are not broken and when the carriage 22 has not been stopped in its downward motion. FIG. 5 illustrates the position of the deflecting rollers 28, if the carriage 22 or the lifting means attached thereto has been stopped by some stationary object during the downward motion of the carriage. In such case, the springs 35 press the slides 33 and, thus, the deflecting rollers upwards to a position where the slides 33 engage the plate 32. At the same time, the microswitch 37 is raised to such an extent that its control arm 38 leaves the plate 31. Now the motor drive is discontinued. As soon as the obstacle has been removed or the motion of the column element has been reversed, the safety means returns to the position shown in FIG. 6, where the compression springs 35 are compressed and the slides 33 engage the plate 31.

Figure 4:
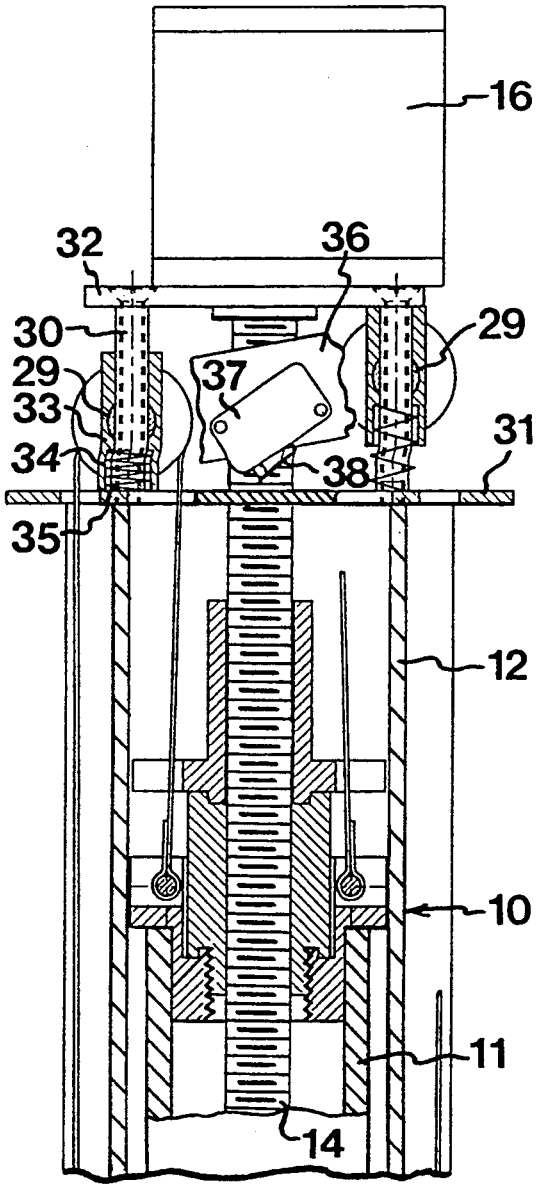
FIG. 4 is a schematic cross-section along the line IV—IV in FIG. 1.

FIG. 4 shows the position of the different parts of the safety means in the case where one belt, i.e. the right-hand belt 26 in FIG. 4, is broken, whereby the compression spring 35 has pressed the shaft 29 of the right-hand deflecting roller to the upper position thereof. The arm 36 is pivoted upwards to such an extent that the microswitch 37 is operated and, thus, the motor drive is discontinued. The pivoting motion of the arm is rendered possible by the above-mentioned elongate hole formed in the arm for accommodating one shaft 29.

In the embodiment of the invention illustrated in FIGS. 1–6, the deflecting rollers 28 thus serve on the one hand as deflecting rollers and, on the other hand, as belt tension sensing means. Within the scope of the invention, it is however possible to use other types of belt tension sensing means for stopping the driving motor in case of insufficient belt tension. In the embodiment shown in FIG. 7, two deflecting rollers 39, 42 are thus used between the belt attachments 25 and 27. One deflecting roller 39 is rotatable about a shaft 40 which is fixedly mounted relative to a movable column element 41. The outer deflecting roller 42 is mounted on a shaft 43 which is displaceable in an elongate hole 44 formed in the column element 41. The shaft 43 is, by means of a compression spring 45, actuated to the left in FIG. 7. The control arm 47 of a microswitch 46 is pressed against the shaft 43 to the left in FIG. 7. If the belt breaks or the downward motion of the carriage 22 is stopped, the spring 45 will press the shaft 43 to the left in FIG. 7. As a result, the control arm 47 is released and the microswitch will interrupt the motor drive.

FIG. 8 illustrates a further example of a belt tension sensing means which is usable for the lifting appliance according to the invention. In this case, the belt tension sensing means is designed as a microswitch 48 whose control arm 49 is, at its outer end, provided with a roller 50 which is pressed against the belt 26. If the belt 26 breaks or if the carriage 22 is stopped in its downward motion, the arm 49 will be pivoted counterclockwise. Consequently, the motor drive will be discontinued.

In the embodiment shown in FIGS. 1–6, use is made of an adjusting screw and a nut for controlling the telescopic motions of the column and, thus, controlling the vertical motions of the carriage 22. However, other drive mechanisms are possible. FIG. 7 thus illustrates an embodiment in which the column element 41 and the column element 51 each support a rack 52, 53 and in which a gear drive 54 is mounted on a shaft 55 and meshes with the two racks. The shaft 55 is driven by a driving motor (not shown).

FIG. 8 illustrates a different type of driving motor for a lifting appliance according to the invention. In this case, use is made of a hydraulic motor 56 which is mounted on the lower column element 51 and whose piston rod 57 is connected to the upper column element 41.

In the embodiment shown in FIGS. 1–6, the driving belt is shaped as a flat belt. However, also other types of belt are useful, such a V-belts, wires, ropes, chains or the like. The embodiment according to FIGS. 1–6 uses two belts 26. Alternatively, only one belt can be used. This also applies to other embodiments. The number of belts may differ.

In the embodiments according to FIGS. 1–6 and 8, compression springs 35, 45 are used in the belt tension sensing means. However, it is possible to use other types of yieldable actuating means, such as tension springs, to produce the desired load on the sensing means.

We claim:

1. Lifting appliance, especially for a patient lifting device, said lifting appliance comprising:

a column made up of two telescopically cooperating column elements, means for adjusting the position of said column elements relative to each other in order to change the length of said column, said adjusting means including a driving motor mounted on one of said column elements, a carriage movably mounted on one of said column elements, moving means for moving said carriage, said moving means including two belts each having a first end and a second end, said belts being attached to said carriage at said first ends, two belt attachments located on one of said column elements, said second ends of said belts attached to one of said belt attachments, belt tension sensing means for stopping said driving motor in case of insufficient belt tension in at least one of the belts, said belt tension sensing means comprises a belt tensioning element yieldably mounted on one of said column elements to yieldably engage both of said belts between said first ends and said second ends, and driving motor control means for controlling said driving motor in response to the position of said belt tensioning element of said belt tension sensing means, the belt tension sensing means further comprising a connecting arm operatively connected to both of the belts, the connecting arm being shifted in response to sufficient belt tension and the driving motor control means being responsive to shifting of the connecting arm to thereby stop driving of the driving motor.

2. Lifting appliance according to claim 1, wherein said belt tensioning element is at least one deflecting roller over which said belt runs.

3. Lifting appliance according to claim 2, wherein said belt tension sensing means further includes at least one guide, at least one shaft, said at least one shaft movably mounted on said at least one guide, and spring means for biasing said at least one shaft in a belt-tensioning direction along said at least one guide.

4. Lifting appliance according to claim 2, wherein two deflecting rollers are provided, each of the belts running over one of the deflecting rollers, both of said belts being connected to said carriage and to one belt attachment on the other of said column elements, and each said deflecting roller connected to said driving motor control means.

5. Lifting appliance according to claim 1, wherein the same column element of said column elements supports said driving motor and said carriage, said driving motor connected to an adjusting screw to drive and rotate said adjusting screw, and a nut means on the other of said column elements engaging said adjusting screw.

6. Lifting appliance according to claim 1, wherein the belt tensioning element comprises one deflecting roller for each of the two belts and wherein the belt tension sensing means further comprises two shafts and two guides, each of the deflecting rollers having one of the two shafts connected thereto and each of the shafts being connected to one of the two guides, the connecting arm being pivotally connected to both of the shafts and the driving motor control means being mounted on the connecting arm.

7. Lifting appliance according to claim 6, wherein said guides are interconnected at one end by an end plate, the driving motor control means comprises a microswitch with a sensing arm engageable with the end plate, the sensing arm being movable with the connecting arm toward and away from the end plate, the sensing arm being disengaged from the end plate in response to insufficient belt tension, the driving motor being operable when the sensing arm is engaged with the end plate and being stopped when the sensing arm disengages from the end plate.

8. Lifting appliance according to claim 7, wherein the sensing arm pivots relative to the shafts in response to insufficient belt tension in one of the belts and the connecting arm moves away from the end plate in response to insufficient belt tension in both of the belts, the driving motor control means stopping the motor in response to pivoting of the connecting arm or movement of the connecting arm away from the end plate.

9. Lifting appliance according to claim 7, further comprising spring means for biasing both of the shafts in a belt tensioning direction, the spring means being mounted around the guides.

10. Lifting appliance according to claim 1, wherein the driving motor control means comprises a microswitch mounted on the belt tension sensing means and wherein the connecting arm is moved in a belt tensioning direction in response to insufficient belt tension in at least one of the belts and the microswitch stops the driving motor upon pivoting or movement of the connecting arm in the belt tensioning direction.

11. Lifting appliance according to claim 1, wherein the arm moves in a belt tensioning direction in response to insufficient belt tension in both of the belts.

12. Lifting appliance according to claim 1, wherein the connecting arm pivots in a belt tensioning direction in response to insufficient belt tension in at least one of the belts.

* * * * *